US008613113B1

(12) United States Patent
Resnick

(10) Patent No.: US 8,613,113 B1
(45) Date of Patent: Dec. 24, 2013

(54) COMPACT PROTECTIVE HOOD WITH VULCANIZED NECK DAM INTERFACE

(76) Inventor: Todd A. Resnick, Stuart, FL (US)

( * ) Notice: Subject to any disclaimer, the term of this patent is extended or adjusted under 35 U.S.C. 154(b) by 546 days.

(21) Appl. No.: 12/392,510

(22) Filed: Feb. 25, 2009

(51) Int. Cl.
*A42B 1/06* (2006.01)

(52) U.S. Cl.
USPC ..... 2/410; 2/202; 2/206; 128/201.23

(58) Field of Classification Search
USPC ..... 2/410, 202, 203, 204, 84, 468, 206, 2/207; 128/201.22, 201.23, 201.25, 128/201.29, 206.21, 206.24
See application file for complete search history.

(56) References Cited

U.S. PATENT DOCUMENTS

| | | | | |
|---|---|---|---|---|
| 536,299 | A | 3/1895 | Schneckloth | |
| 2,888,011 | A | 5/1959 | Penrod et al. | |
| 3,521,629 | A | 7/1970 | Reynolds | |
| 3,562,813 | A | 2/1971 | Origer | |
| 3,704,891 | A * | 12/1972 | Chiarelli | 473/446 |
| 4,057,058 | A | 11/1977 | Kovacevic | |
| 4,231,359 | A | 11/1980 | Martin | |
| 4,552,140 | A | 11/1985 | Cowley et al. | |
| 4,637,383 | A | 1/1987 | Lopez | |
| 4,670,075 | A * | 6/1987 | Heckel et al. | 156/222 |
| 4,757,813 | A | 7/1988 | Haydu | |
| 4,807,614 | A * | 2/1989 | van der Smissen et al. | 128/201.23 |
| 4,864,654 | A * | 9/1989 | Schriver et al. | 2/84 |
| 4,870,959 | A | 10/1989 | Reisman et al. | |
| 4,896,665 | A | 1/1990 | Gervais | |
| 4,961,420 | A * | 10/1990 | Cappa et al. | 128/207.12 |
| 5,049,431 | A * | 9/1991 | Heckel et al. | 156/252 |
| 5,113,854 | A * | 5/1992 | Dosch et al. | 128/201.23 |
| 5,186,165 | A | 2/1993 | Swann | |
| D365,665 | S | 12/1995 | Januszewski, Jr. | |
| 5,495,847 | A * | 3/1996 | Hu | 128/202.26 |
| 5,526,804 | A | 6/1996 | Ottestad | |
| 5,724,958 | A * | 3/1998 | Farnworth et al. | 128/201.23 |
| 5,865,175 | A | 2/1999 | Chu | |
| 5,884,336 | A * | 3/1999 | Stout | 2/206 |
| 6,269,489 | B1 * | 8/2001 | Heath | 2/173 |
| 6,272,690 | B1 * | 8/2001 | Carey et al. | 2/206 |
| 6,279,571 | B1 | 8/2001 | Meckes | |
| 6,371,116 | B1 * | 4/2002 | Resnick | 128/206.24 |
| 6,450,165 | B1 | 9/2002 | Silver et al. | |
| 6,460,538 | B1 | 10/2002 | Kemp | |
| 6,701,920 | B1 | 3/2004 | Cox | |
| 6,701,925 | B1 * | 3/2004 | Resnick | 128/206.17 |
| 6,763,835 | B1 * | 7/2004 | Grove et al. | 128/857 |
| 6,834,646 | B2 | 12/2004 | Alon et al. | |
| 6,843,480 | B2 * | 1/2005 | Nelson et al. | 277/338 |
| 6,854,459 | B1 | 2/2005 | Cox | |
| 6,892,725 | B2 * | 5/2005 | Frund | 128/201.29 |
| 6,997,179 | B1 | 2/2006 | Niemann | |
| 7,210,477 | B2 | 5/2007 | Templeton et al. | |

(Continued)

OTHER PUBLICATIONS

Teflon PFA 345 fluoropolymer resin, Extrusion and Molding Resin. Du Pont Product Information. 1999.

*Primary Examiner* — Khoa Huynh
*Assistant Examiner* — Andrew W Collins
(74) *Attorney, Agent, or Firm* — Anton J. Hopen; David Jacobs; Smith & Hopen, P.A.

(57) ABSTRACT

A method of constructing a compact protective hood comprising the steps of vulcanizing a heat-resistant, non-elastic crown to an elastomeric neck dam, the neck dam formed by injection molding directly to the crown.

4 Claims, 6 Drawing Sheets

(56) References Cited

U.S. PATENT DOCUMENTS

| | | | | |
|---|---|---|---|---|
| 7,213,320 | B1 * | 5/2007 | Holmquist et al. | 29/428 |
| 7,357,135 | B2 | 4/2008 | Cunningham et al. | |
| 2003/0200966 | A1 * | 10/2003 | Frund, Jr. | 128/201.29 |
| 2005/0121029 | A1 * | 6/2005 | Reisman | 128/201.22 |
| 2005/0155136 | A1 * | 7/2005 | Colletti et al. | 2/206 |
| 2005/0193472 | A1 * | 9/2005 | Courtney et al. | 2/202 |
| 2005/0268907 | A1 * | 12/2005 | McFarlane | 128/201.22 |
| 2006/0032498 | A1 | 2/2006 | Niemann | |
| 2006/0085881 | A1 * | 4/2006 | Gellis et al. | 2/9 |
| 2006/0118116 | A1 | 6/2006 | Porat | |
| 2006/0283455 | A1 | 12/2006 | Walker et al. | |
| 2007/0113845 | A1 * | 5/2007 | O'Brien et al. | 128/201.19 |
| 2008/0105255 | A1 | 5/2008 | Resnick | |
| 2010/0218761 | A1 * | 9/2010 | Flannigan et al. | 128/201.19 |

* cited by examiner

COMPACT PROTECTIVE HOOD WITH VULCANIZED NECK DAM INTERFACE

FIELD OF INVENTION

This invention relates to a compact protective escape hood design that provides high fluid impermeability, mechanical strength, and efficient assembly.

BACKGROUND OF THE INVENTION

Compact protective hoods enclose the head of a wearer in a crown either of transparent material or of opaque material with a transparent visor. Respiration is typically filtered through a mouth piece, oral-nasal cup or a full-face piece. The hood is sealed about the neck by an elastomeric dam. To make the package compact and portable the hood assembly size must be as small as possible which is accomplished by folding the hood assembly for storage until deployment.

Limitations in Fluid Impermeability Technology

Protective hoods require fluid impermeability to maintain a target protection factor. Fluid impermeability is tested by a number of methods. In one method, the hood is inflated with air and a soapy solution is applied to the exterior of the hood. Alternatively the inflated hood may be partially submerged to detect leaks. Leaks in the hood are detected by bubbles forming proximate to the leak. Leaks are most likely to occur about material interfaces such as those between the crown and the elastomeric neck dam.

As noted above, the material requirements between the crown and neck dam differ. The crown must provide a fluid impermeable three dimensional surface to surround the head of a wearer. It must interface with a visor for outward vision or be constructed of transparent material. The crown must also interface with a filtered respiratory pathway between the interior and exterior of the hood.

The neck dam must be substantially elastomeric to fit over the wearer's head and seal against the neck of the wearer. However, the neck dam must also create a fluid impermeable seal with the crown. As the crown and neck dam are typically made from different materials, this seal can be challenging to achieve effectively. Many bonding agents, tape and other methods produce an acceptable fluid impermeable seal but do not provide high mechanical strength. Stitching and other mechanical fasteners provide mechanical strength but sacrifice fluid impermeability. Both mechanical strength and fluid impermeability are inextricably intertwined as the donning of the hood introduces substantial mechanical strain on the neck dam-crown interface as the neck dam must be stretched to accommodate the greater diameter of the head of the wearer before contracting around the lesser diameter of the neck of the wearer. Additional stress is also incurred during the folding and unfolding process.

SUMMARY OF INVENTION

The present invention includes a method of constructing a compact protective hood comprising the steps of vulcanizing a heat-resistant, non-elastic crown to an elastomeric neck dam that is directly injected molded to the crown.

Vulcanization is a chemical process in which polymer molecules are linked to other polymer molecules by atomic bridges of sulfur atoms or carbon to carbon bonds. The molecules become cross-linked which makes the bulk material harder, much more durable and also more resistant to chemical attack. It also makes the surface of the material smoother and prevents it from sticking to metal or plastic chemical catalysts. This heavily cross-linked polymer has strong covalent bonds, with strong forces between the chains, and is therefore an insoluble and infusible, thermosetting polymer. All these characteristics make the material ideal for creating mechanically strong, fluid impermeable hood assemblies.

High vulcanization temperatures may increase bonding speed and therefore result in a higher manufacturing output. For this reason, fluoropolymer resins such as those sold under the brand TEFLON PFA 345 by DuPont Fluoroproducts out of Wilmington, Del., USA are ideal materials as they can be made transparent and have high melting points that exceed typical vulcanization temperatures of 338 degrees Fahrenheit. It should be noted that any other heat-resistant materials may be utilized provided they have a sufficiently high enough melting point to withstand a vulcanization process.

In an embodiment of the invention, the crown is pre-molded so that visor cutouts, filter pathways and other features are already formed when the crown comes out of the mold. Advantages of pre-forming these features include reduced assembly time and higher precision in their location on the crown. The crown is defined by a lower perimeter opening which receives the head of the wearer and an upper portion in which the wearer's head is enclosed when the hood is donned. It should be noted that embodiments of the hood include using certain resins to form an entirely transparent crown wherein no distinct visor assembly is needed. In yet another embodiment of the invention surface texture in the crown mold may impart opacity in certain areas of the hood and transparency in other areas such as needed for outward vision. Surface texture may provide an additional advantage of diffusing reflected light so that hood wearers are better camouflaged.

Direct molding of the elastomeric neck dam to the crown may be accomplished by a variety of methods including, but not limited to, compaction plus sintering, injection molding, compression molding, transfer molding, and dip molding. In any mold process selected, the lower perimeter of the crown both mechanically engages and fluidly seals to the elastomeric neck dam.

Also formed within the mold are three-dimensional variations about the lower perimeter opening of the crown. In one embodiment a plurality of apertures about the lower perimeter of the crown are provided whereby the liquid elastomeric material of the neck dam flows into the interstial space of the apertures before cooling to a solid state. This provides a mechanical engagement between the crown and neck dam. The apertures may be of any predetermined geometric configuration. In an alternative embodiment, protrusions may be formed by the crown mold to engage the elastomeric material. In yet another embodiment, convex or concave concentric rings about the lower perimeter of the crown may be used to enhance the bond between the crown and the elastomeric material.

In an alternative embodiment of the invention, the hood is pre-molded in a semi-folded state whereby folding is facilitated as the hood is naturally biased towards a folded state and expanded against the folded bias when deployed. This provides yet another advantage as the hood assembly may be repacked for reuse with minimal packing expertise.

The present invention includes a number of advantages over the state of the art. These include:

Adhesives not necessary: Adhesives break down over time. Vulcanization does not. Accordingly, hoods manufactured with this method will have longer shelf lives and greater reliability.

Mechanical strength: Liquid elastomeric material in the neck dam mold migrates to the interstitial space formed by apertures perforated about the lower perimeter of the crown. Alternatively the liquid elastomeric material engages any other three-dimensional surface variation on the lower perimeter of the crown. As the elastomeric material cures, a strong mechanical interface is formed. Longer life and a greater protection factor are achieved.

Transparent hood: Using this method, a substantially transparent hood is possible thereby providing a wider field of view and removing a point of failure at the visor-hood interface which is obviated.

Manufacturing Expense: Using this method obviates the need for a multi-part neck seal. Manufacturing costs are reduced and fewer points of failure exist.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
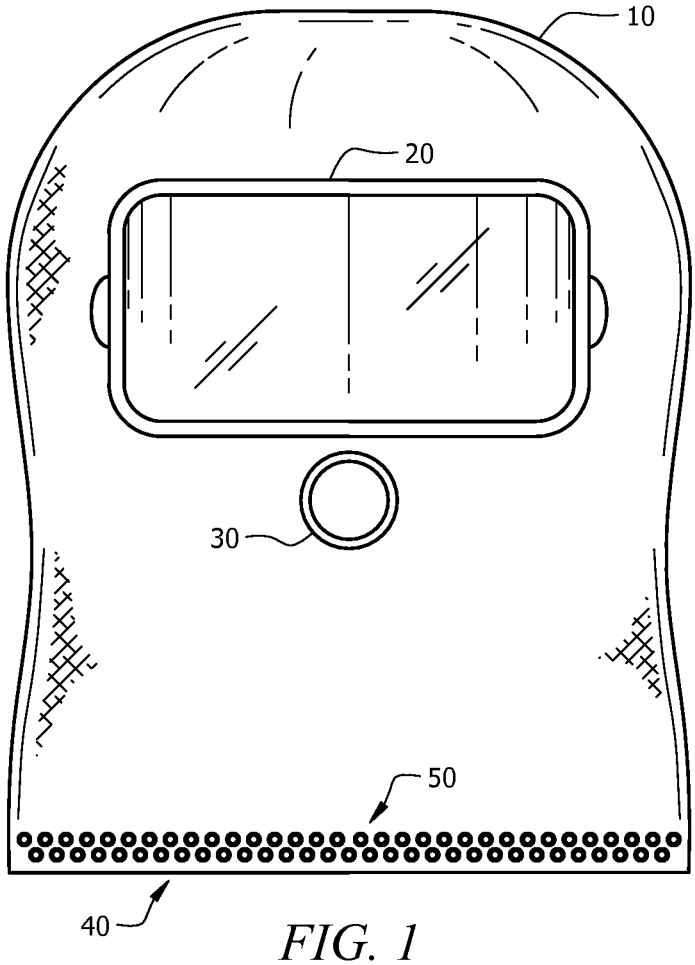
FIG. 1 is an elevated view of an embodiment of the invention showing a hood crown with a plurality of apertures about its lower perimeter.
Figure 2:
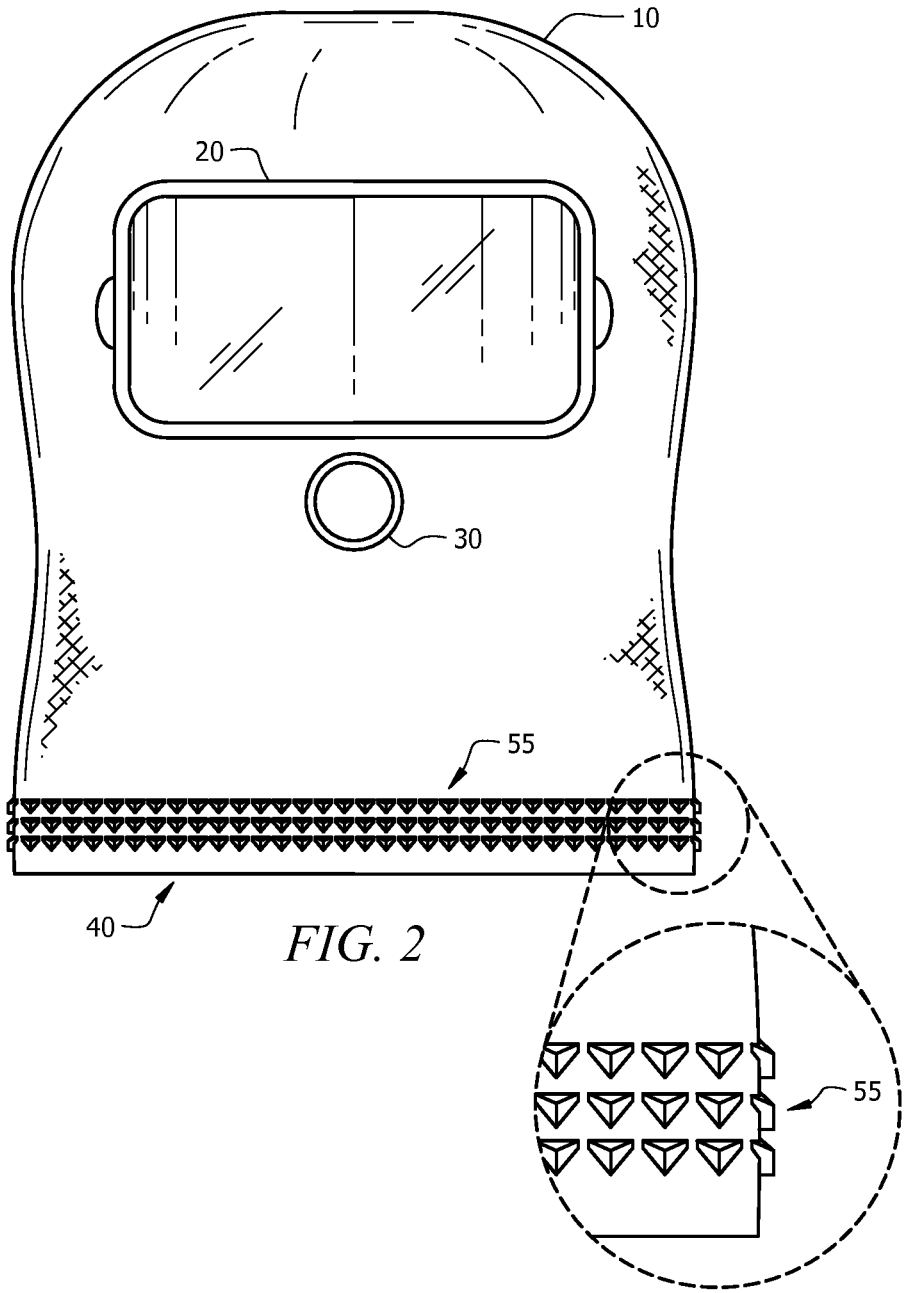
FIG. 2 is an elevated view of an embodiment of the invention showing a hood crown with three-dimensional surface variations pre-molded about its lower perimeter.

In FIG. 1, crown 10 has pre-molded visor aperture 20 and pre-molded respiration aperture 30. Lower perimeter 40 receives the head of a wearer and in this embodiment, a plurality of apertures 50 about lower perimeter are either preformed in the crown's mold or die cut after the crown is molded. Apertures 50 are sized to permit liquid elastomeric material to fill the interstitial space of each aperture during the injection molding of the neck dam. The purpose of apertures 50 is to provide mechanical strength to the bond between crown and neck dam. This is particularly important due to the stresses that occur between neck dam and crown. When the hood is donned, the neck dam must be stretched over the head of the wearer before it resiliently engages the neck of the wearer to create a substantially fluid-tight seal. This stretching puts strain on the interface between the neck dam and the crown. FIG. 2 illustrates an alternative embodiment to apertures 50 wherein three-dimensional surface variations 55 provide a substrate upon which the elastomeric material can engage. Surface variations 55 may be formed on the interior of crown 10, exterior of crown 10 or on both sides. Surface variations 55 may be formed from crown's mold whereby no additional labor is required for their formation. Surface variations 55 may include, but are not limited to, projections, concentric convex rings, concentric concave rings, predetermined geometric shapes, dimples and the like. It is also anticipated that a combination of apertures 50 and surface variations 55 may be used.

Figure 3A:
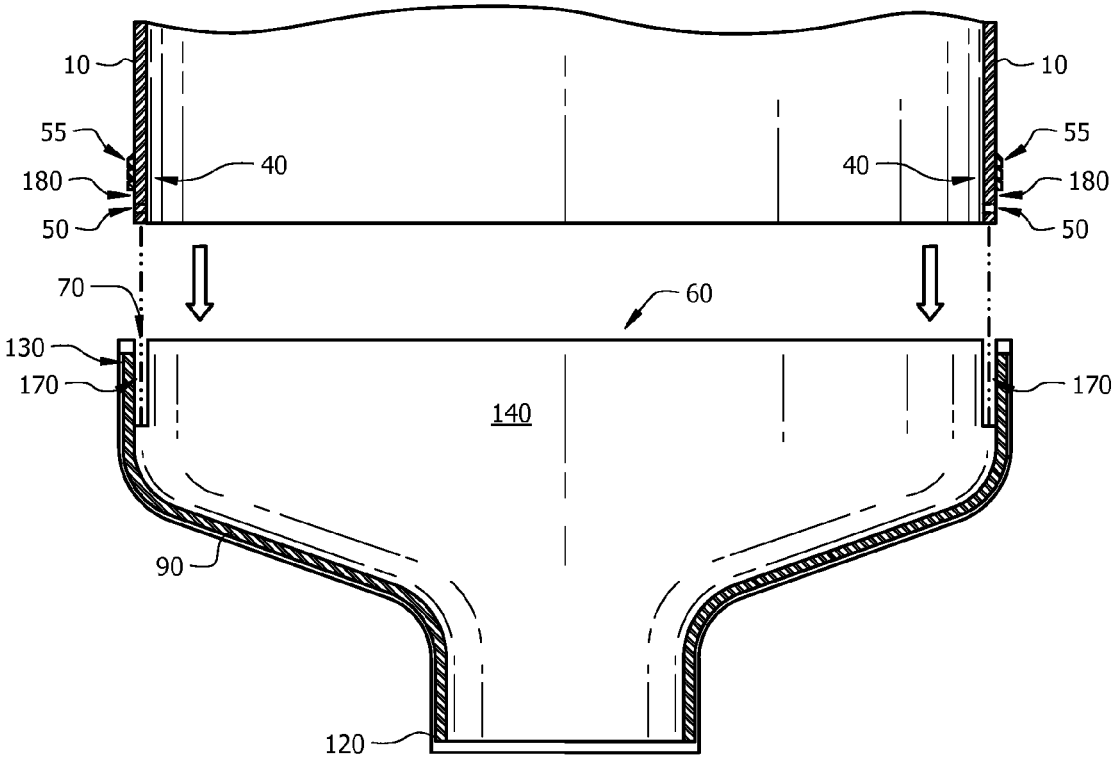
FIG. 3A is a cross-section view of an exemplary injection mold cavity for forming the elastomeric neck dam.
Figure 3B:
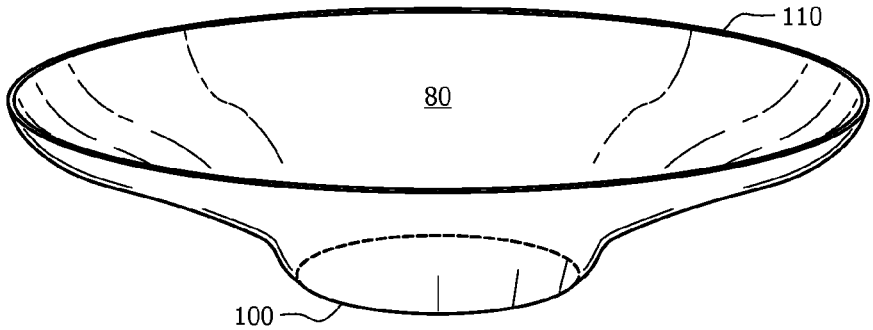
FIG. 3B is a partially sectional, perspective view of an exemplary neck dam shape.

FIG. 3A is an illustrative embodiment of an injection mold 60 that forms the elastomeric neck dam 80 (FIG. 3B). Lower perimeter 40 of crown 10 is received through mold opening 70. Heated elastomeric material in a liquid state forms in cavity 90. Cavity 90 forms a substantially conical ring defined by neck opening 100 formed by lower mold terminus 120 and outer ring perimeter 110 formed by upper mold terminus 130. It should be noted that neck dam 80 in FIG. 3B is shown for illustrative purposes detached from crown 10. Anvil 140 fills the interstitial space of injection mold 60 to give neck dam 80 predetermined thickness by forming cavity 90. Chamfer 170 in anvil 140 receives lower perimeter 40 of crown 10. In the embodiment illustrated in FIG. 3A, lower perimeter 40 has alternating rings of apertures 50, a smooth surface 180 and surface variations 55. It should be noted that any combination of alternating surfaces may be used. However, an enhanced protection factor is achieved by alternating a ring of smooth surface 180 (for fluid impermeability) with a ring of surface variations 55 or apertures 50 (for enhanced mechanical bonding).

Figure 4:
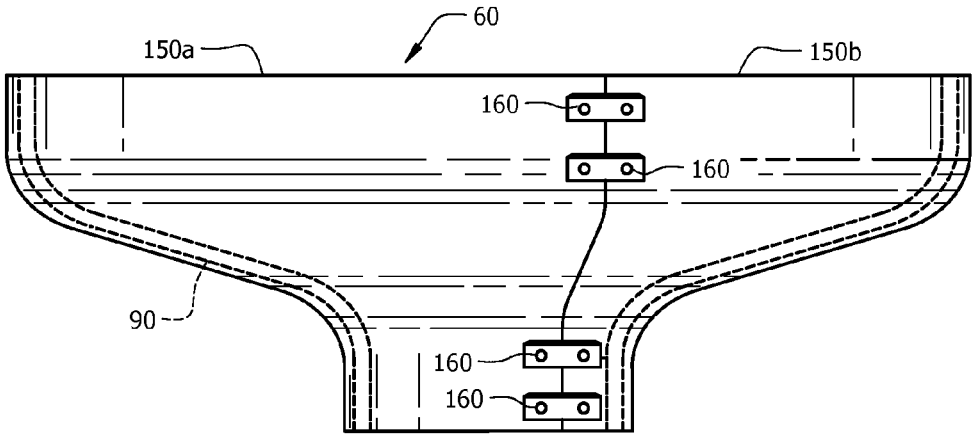
FIG. 4 is a partially sectional, front elevation view of an exemplary injection mold cavity for forming the elastomeric neck dam.
Figure 5:
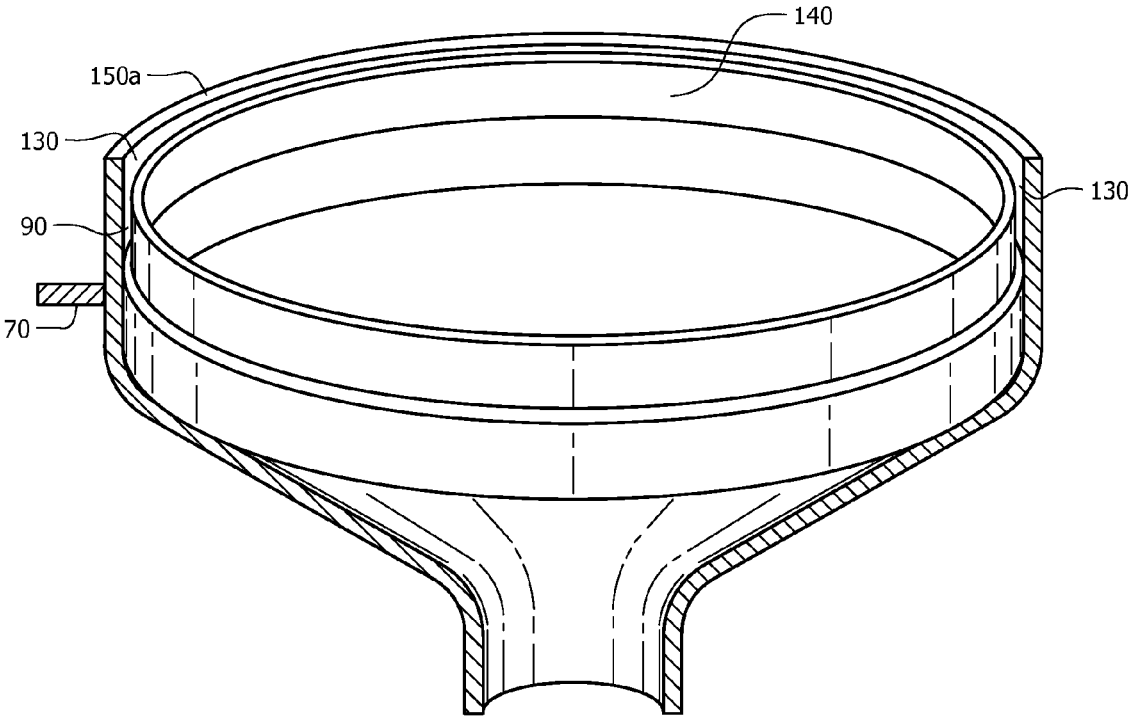
FIG. 5 is a partially sectional, elevated isometric view of an exemplary injection mold cavity for forming the elastomeric neck dam.
Figure 6:
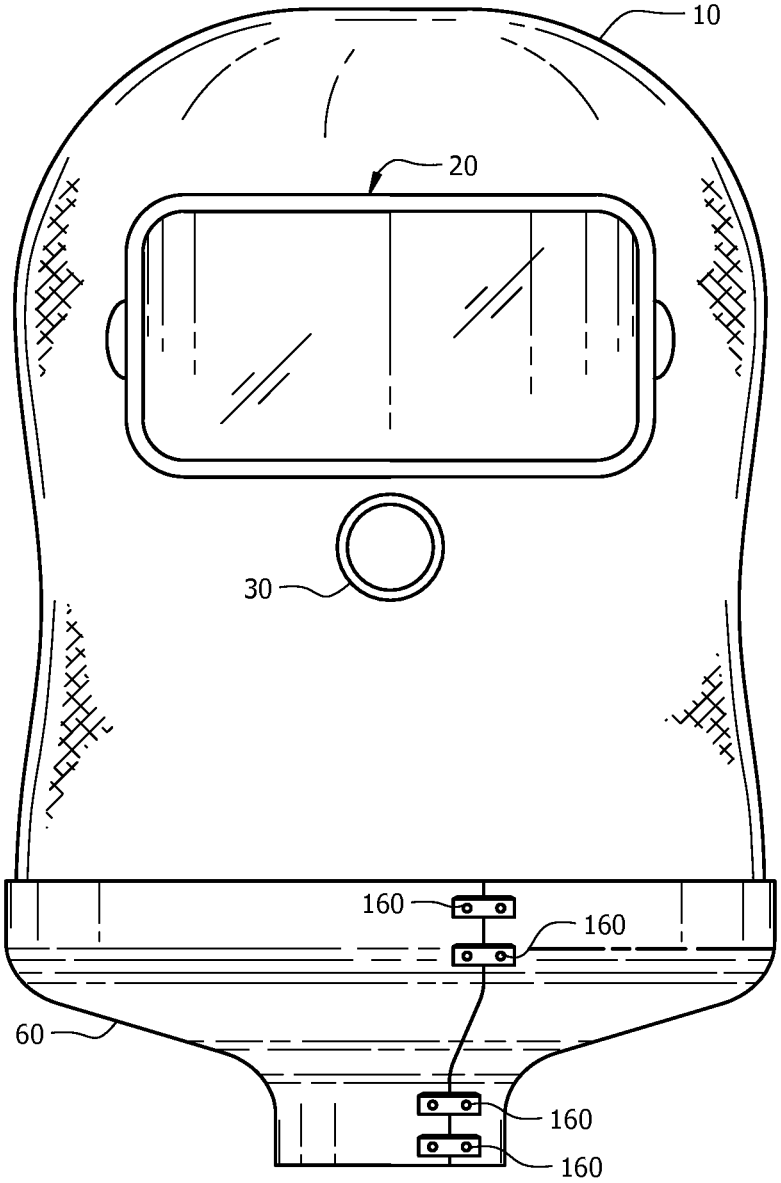
FIG. 6 is a front elevated view of the crown engaged in the injection mold cavity for forming the elastomeric neck dam.
Figure 7:
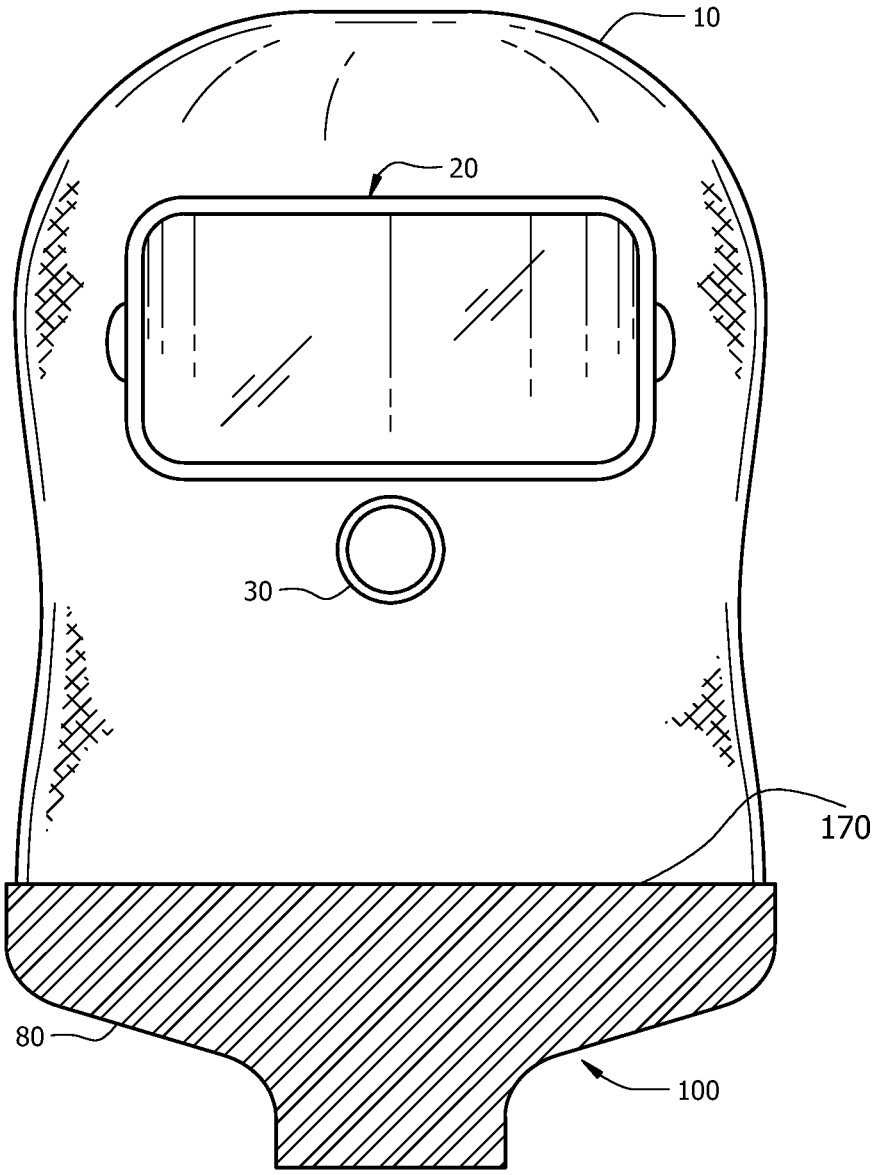
FIG. 7 is a front elevated view of the crown and elastomeric neck dam removed from the mold cavity and ready for vulcanization.

FIG. 4 shows an embodiment of the invention wherein injection mold 60 is formed by two outer molds halves 150A and 150B secured by clamps 160 about inner mold surface 140 to form cavity 90. It should be noted that clamps 160 are provided as a simplified embodiment of the invention. High-volume mold design may employ an alternative embodiment wherein the two halves 150A and 150B are aligned and engaged via hydraulic pistons or the like. FIG. 5 shows an isometric view of outer mold half 150A and inner mold surface 140 forming cavity 90. Upper mold terminus 130 engages crown 10 lower perimeter 40 and seals cavity 90 so that liquid elastomeric material injected into mold 60 via injection port 70 does not leak out. FIG. 6 shows crown 10 engaged with mold 60. It should be noted that alternatively, mold 60 may entirely encase crown 10 from top to bottom during the injection mold process. FIG. 7 shows crown 10 removed from mold 60 whereby neck dam 80 is fused by only one 170 to lower perimeter 40.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A compact protective hood comprising:

a substantially non-elastic one-piece crown defined by a lower perimeter in which a wearer's head is received and an upper portion in which the head is located when the crown is donned;

a plurality of integral surface variations encircling an area above the lower perimeter of the crown; and an elastomeric neck dam directly molded to the lower perimeter of the crown forming a mechanically engaged, fluid impermeable, vulcanized neck dam and crown assembly, whereby the elastomeric neck dam is directly molded the integral surface variations encircling the area above the lower perimeter of the crown and wherein only one fused seal exists to connect the neck dam and crown together.

2. The hood of claim 1 wherein the crown is a fluoropolymer having a melting point above 338 degrees Fahrenheit.

3. A compact protective hood comprising:

a substantially non-elastic one-piece crown having a melting point above 338 degrees Fahrenheit, the crown defined by a lower perimeter in which a wearer's head is received and an upper portion in which the head is located when the crown is donned;

a plurality of apertures encircling an area above the lower perimeter of the crown; and an elastomeric neck dam directly molded to and penetrating the plurality of apertures forming a mechanically engaged, fluid impermeable, vulcanized neck dam and crown assembly, whereby the elastomeric neck dam is directly molded to the area above the lower perimeter of the crown by its engagement with the apertures and wherein only one fused seal exists to connect the neck dam and crown.

4. The hood of claim 3 wherein crown is substantially transparent thereby obviating the need for a separate visor assembly in the crown.

* * * * *